US009754456B2

(12) United States Patent
Verstraeten

(10) Patent No.: US 9,754,456 B2
(45) Date of Patent: Sep. 5, 2017

(54) AMUSEMENT MACHINE OF THE PUSHER TYPE

(71) Applicant: Elaut N.V., Sint-Niklaas (BE)

(72) Inventor: Eric Verstraeten, Sint-Niklaas (BE)

(73) Assignee: Elaut N.V., Sint-Niklaas (BE)

( * ) Notice: Subject to any disclaimer, the term of this patent is extended or adjusted under 35 U.S.C. 154(b) by 132 days.

(21) Appl. No.: 14/940,924

(22) Filed: Nov. 13, 2015

(65) Prior Publication Data

US 2016/0140811 A1 May 19, 2016

(30) Foreign Application Priority Data

Nov. 14, 2014 (BE) ..... 2014/5066

(51) Int. Cl.
*G07F 17/38* (2006.01)
*G07F 17/32* (2006.01)

(52) U.S. Cl.
CPC ..... *G07F 17/3297* (2013.01); *G07F 17/38* (2013.01)

(58) Field of Classification Search
CPC ..... G07F 17/3297; G07F 17/38
See application file for complete search history.

(56) References Cited

U.S. PATENT DOCUMENTS

2002/0014739 A1* 2/2002 Williams ..... G07F 17/3244 273/138.1
2003/0073479 A1 4/2003 Wilson et al.
2005/0087926 A1* 4/2005 Hattori ..... G07F 17/3297 273/138.3
2009/0033032 A1* 2/2009 Niwa ..... G07F 17/3297 273/138.3
2010/0096803 A1* 4/2010 Sasaki ..... G07F 17/3297 273/138.3
2013/0069303 A1* 3/2013 Hasegawa ..... G07F 17/3297 273/138.1
2013/0320618 A1* 12/2013 Crompton ..... A63F 7/02 273/109

(Continued)

FOREIGN PATENT DOCUMENTS

BE EP 3021298 A1 * 5/2016 ..... G07F 17/38
EP 0755033 A1 1/1997
GB WO 0188868 A1 * 11/2001 ..... G07F 17/3244

(Continued)

*Primary Examiner* — Raleigh W Chiu
(74) *Attorney, Agent, or Firm* — The Webb Law Firm

(57) ABSTRACT

Amusement machine of the pusher type, comprising a playing surface on which a plurality of playing pieces as well as one or more prizes are supported, wherein the prizes have a shape and/or size differing from the shape and/or size of a playing piece, and a playing piece pusher configured to move over the playing surface at successive points in time in order to disturb the plurality of playing pieces and prizes supported on the playing surface; a transport system with at least one collecting location for collecting the one or more playing pieces and prizes which have dropped over the edge, and at least one infeed location which lies higher than the at least one collecting location, which transport system is configured to reintroduce the one or more playing pieces and prizes onto the playing surface from the at least one infeed location; and to transport the one or more playing pieces and prizes from the at least one collecting location to the at least one infeed location.

20 Claims, 10 Drawing Sheets

(56) References Cited

U.S. PATENT DOCUMENTS

| | | | | | |
|---|---|---|---|---|---|
| 2016/0140811 | A1* | 5/2016 | Verstraeten | ..... | G07F 17/3297<br>273/454 |

FOREIGN PATENT DOCUMENTS

| | | | | | | |
|---|---|---|---|---|---|---|
| GB | 2379614 | A | * | 3/2003 | ..... | G07F 17/3297 |
| GB | 2381211 | A | * | 4/2003 | ..... | G07F 17/3297 |
| GB | 2381469 | A | * | 5/2003 | ..... | G07F 17/3297 |
| GB | 2381757 | A | * | 5/2003 | ..... | G07F 17/3297 |
| WO | 2004055747 | A1 | | 7/2004 | | |

* cited by examiner

AMUSEMENT MACHINE OF THE PUSHER TYPE

CROSS-REFERENCE TO RELATED APPLICATION

This application claims priority to Belgian Patent Application No. 2014/5066 filed Nov. 14, 2014, the disclosure of which is hereby incorporated in its entirety by reference.

BACKGROUND OF THE INVENTION

Field of the Invention

The present invention relates to an amusement machine of the pusher type in which a plurality of playing pieces such as coins, chips or marbles are used for gameplay, as well as one or more prizes.

Description of Related Art

Amusement machines of the pusher type have existed for years and can be subdivided into traditional pushers, in which playing pieces in the form of coins, tokens or chips are paid out to a player, and more recent variants in which the coins or chips circulate in a closed loop in the machine and reintroduced into the game by means of hoppers. Such an amusement machine is for instance described in EP 0 755 033.

In addition, it is known to add prizes to the playing pieces in order to make the game more exciting. These prizes can be added as prize tokens having the same shape as the playing pieces. According to another variant, the prizes have a different shape and are paid out to a player by a separate dispensing module. An operator then has to regularly add new prizes to the machine.

SUMMARY OF THE INVENTION

According to a first aspect of the invention, an amusement machine of the pusher type is provided. The amusement machine comprises a playing surface, a playing piece pusher and a transport system. A plurality of playing pieces, such as coins, chips or marbles, as well as one or more prizes are supported on the playing surface, wherein the one or more prizes have a shape and/or size differing from the shape and/or size of a playing piece of the plurality of playing pieces. The playing piece pusher is configured to move over the playing surface at successive points in time in order to disturb the plurality of playing pieces and one or more prizes supported on the playing surface, wherein the playing surface and the playing piece pusher are arranged such that one or more playing pieces and/or prizes can drop over an edge of the playing surface during movement of the playing piece pusher. The transport system comprises at least one collecting location for collecting the one or more playing pieces and prizes which have dropped over the edge, and at least one infeed location which lies higher than the at least one collecting location. The transport system is configured to reintroduce the one or more playing pieces and prizes onto the playing surface from the at least one infeed location, and the transport system is configured to transport the one or more playing pieces and prizes from the at least one collecting location to one of the at least one infeed location.

Providing a transport system which circulates both prizes and playing pieces in a closed loop in the machine avoids an operator having to replenish the prizes. An extra dimension is further imparted to the game in that a player knows that the prize is reintroduced onto the playfield.

The prizes are preferably larger than the playing pieces and typically lie on top of the playing pieces. The volume of a prize is preferably at least twice, still more preferably at least four times, the volume of a playing piece. The prizes are for instance one or more of the following: objects provided with an indication, for instance a colour, associated with a corresponding number of points, for instance blocks of different shapes and colours and so on. These can for instance be rectangular, heart-shaped or star-shaped blocks. Different types of prize are preferably present in the machine, and these prizes are associated with a different number of points. The number of playing pieces is preferably at least 10 times greater than the number of prizes, still more preferably at least 100 times greater.

The transport system is preferably configured to circulate in a closed loop all playing pieces and prizes present in the machine, i.e. no playing pieces or prizes are paid out to the players.

According to a preferred embodiment, the amusement machine further comprises a detection module configured to detect one or more prizes which have dropped over the edge and an award module for awarding a number of prize points to the player in accordance with the detected one or more prizes which have dropped over the edge. These prize points can optionally be shown on a display screen of the machine. These prize points can for instance be paid out to a player by means of a ticket dispensing module which prints a ticket stating the number of prize points. If use is made of different types of prize associated with different points, the detection module is preferably then configured to detect the type of prize so that the corresponding number of points can be calculated therefrom.

According to an exemplary embodiment, the at least one collecting location comprises a first collecting location configured to collect playing pieces and prizes, and the at least one infeed location comprises a first infeed location configured to collect playing pieces and prizes. A first lift module configured for joint transport of the playing pieces and prizes is then preferably provided between the first collecting location and the first infeed location. In this embodiment the prizes and playing pieces thus circulate together in one closed loop.

According to an exemplary embodiment, the at least one collecting location comprises a first collecting location configured to collect prizes without playing pieces and a second collecting location configured to collect playing pieces without prizes, and the at least one infeed location comprises a first infeed location configured for infeed of prizes and a second infeed location configured for infeed of playing pieces. A first lift module configured to transport the prizes collected in the first collecting location is preferably provided between the first collecting location and the first infeed location, and a second lift module configured to transport the playing pieces collected in the second collecting location is provided between the second collecting location and the second infeed location. Two closed loops can thus be distinguished in this embodiment: one for the prizes and one for the playing pieces.

In an exemplary embodiment the first lift module comprises drive means for moving the lift module obliquely or vertically upward from the first collecting location to the first infeed location and back, and a control unit for controlling the drive means in accordance with a state of the game.

In an exemplary embodiment the second lift module comprises a hopper module configured to move the playing pieces upward in an orderly row. In an exemplary embodiment the machine comprises a swing arm which connects to the second location and which is configured to move over the playing surface, which swing arm is further configured to guide the playing pieces through the swing arm to an outlet of the swing arm, which outlet is located above the playing surface.

In an exemplary embodiment the transport system comprises a discharge channel between the edge of the playing surface and the at least one collecting location, which discharge channel has an inlet into which drop the one or more playing pieces and prizes which have dropped over the edge, and has at least one outlet which connects to the at least one collecting location. The detection module is preferably provided along the discharge channel for detecting one or more prizes in the discharge channel. A prize can in this way be detected immediately after it has dropped over the edge of the playing surface, and an appropriate number of prize points can be awarded to the player. The discharge channel can for instance comprise an inclining surface and/or a conveyor belt. A controllable closing means can further be provided in the discharge channel for temporarily holding back the one or more playing pieces and/or prizes, for instance because a first or second lift module is not yet in the correct position.

In an embodiment with a first and second collecting/infeed location the discharge channel can be provided with a first outlet which connects to the first collecting location and with a second outlet which connects to the second collecting location. A sorting and discharge mechanism is then preferably provided in the discharge channel for discharging prizes to the first outlet and for discharging playing pieces to the second outlet.

According to an advantageous embodiment, the transport system comprises a first lift module movable between the first collecting location and the higher first infeed location, and drive means for moving the lift module from the first collecting location to the first, higher infeed location and back, which lift module is configured to support one or more playing pieces and/or prizes. With such a lift module prizes, and optionally also playing pieces, can thus be transported to the first infeed location, and they can be reintroduced onto the playfield from the first infeed location. The first lift module is preferably provided with a receiving means which can be placed in a first position for receiving prizes, and optionally also playing pieces, in the first collecting location and can be placed in a second position for dispensing prizes, and optionally also playing pieces, in the first infeed location. The amusement machine can further comprise operating means controllable by a player and a drive means for moving the receiving means from the first to the second position, which operating means are coupled to the drive means. A player will in this way be able to determine the moment at which a prize and/or playing piece drops back onto the playing surface.

According to another variant, the transport system comprises an Archimedes screw with a lower end adjacent to the collecting location and an upper end adjacent to the infeed location. The screw thus functions here as a transport means which moves the playing pieces and prizes upward together, wherein the dimensions of the screw are such that both prizes and playing pieces can be transported by the screw.

According to an advantageous embodiment, a guide is provided between the higher first infeed location and the playing surface, which guide is configured to guide the one or more playing pieces and prizes from the first infeed location to the playing surface. The guide is preferably a downward inclining surface.

According to an advantageous embodiment, the amusement machine is a multiplayer with a plurality of playing surfaces, including the stated playing surface, which plurality of playing surfaces are arranged around a central zone, wherein the first collecting location and the first infeed location lie one above the other in the central zone.

According to exemplary embodiments, the amusement machine may be defined according to any one of the following clauses:

1. An amusement machine of the pusher type, comprising: a playing surface on which a plurality of playing pieces, such as coins, chips or marbles, as well as one or more prizes are supported, wherein the one or more prizes have a form and/or size differing from the form and/or size of a playing piece of the plurality of playing pieces, and a playing piece pusher configured to move over the playing surface at successive points in time in order to disturb the plurality of playing pieces and one or more prizes supported on the playing surface, wherein the playing surface and the playing piece pusher are arranged such that one or more playing pieces and/or prizes can drop over an edge of the playing surface during movement of the playing piece pusher; a transport system with at least one collecting location for collecting the one or more playing pieces and prizes which have dropped over the edge, and at least one infeed location which lies higher than the at least one collecting location, which transport system is configured to reintroduce the one or more playing pieces and prizes onto the playing surface from the at least one infeed location;

wherein the transport system is configured to transport the one or more playing pieces and prizes from the at least one collecting location to the at least one infeed location.

2. The amusement machine of clause 1, wherein the prizes are larger than the playing pieces.

3. The amusement machine of clause 1 or 2, wherein the number of playing pieces is at least 10 times greater than the number of prizes, more preferably at least 100 times greater.

4. The amusement of any of the foregoing clauses, wherein the transport system is configured to circulate the plurality of playing pieces and one or more prizes in a closed loop in the amusement machine.

5. The amusement machine of any of the foregoing clauses, further comprising a detection module configured to detect one or more prizes which have dropped over the edge, and an award module for awarding a number of prize points to the player in accordance with the detected one or more prizes which have dropped over the edge.

6. The amusement machine of any of the foregoing clauses, wherein the at least one collecting location comprises a first collecting location configured to collect playing pieces and prizes, and wherein the at least one infeed location comprises a first infeed location configured to collect playing pieces and prizes.

7. The amusement machine of clause 6, wherein a first lift module configured for joint transport of the playing pieces and prizes is provided between the first collecting location and the first infeed location.

8. The amusement machine of any of the clauses 1-6, wherein the at least one collecting location comprises a first collecting location configured to collect prizes without playing pieces and a second collecting location configured to collect playing pieces without prizes, and wherein the at least one infeed location comprises a first infeed location configured for infeed of prizes and a second infeed location configured for infeed of playing pieces.

9. The amusement machine of clause 8, wherein a first lift module configured to transport the prizes collected in the first collecting location is provided between the first collecting location and the first infeed location, and wherein a second lift module configured to transport the playing pieces collected in the second collecting location is provided between the second collecting location and the second infeed location.

10. The amusement machine of clause 7 or 9, wherein the first lift module comprises drive means for moving the lift module vertically upward from the first collecting location to the first infeed location and back, and a control unit for controlling the drive means in accordance with a state of the game.

11. The amusement machine of clause 9, wherein the second lift module comprises a hopper module configured to move the playing pieces upward in an orderly row.

12. The amusement machine of clause 8, 9 or 11, further comprising a swing arm which connects to the second location and which is configured to move over the playing surface, which swing arm is further configured to guide the playing pieces through the swing arm to an outlet of the swing arm, which outlet is located above the playing surface.

13. The amusement machine of any of the foregoing clauses, wherein the transport system comprises a discharge channel between the edge of the playing surface and the at least one collecting location, which discharge channel has an inlet into which drop the one or more playing pieces and prizes which have dropped over the edge, and has at least one outlet which connects to the at least one collecting location.

14. The amusement machine of clauses 5 and 13, wherein the detection module is provided along the discharge channel for detecting one or more prizes in the discharge channel.

15. The amusement machine of clause 12 and any of the clauses 8, 9, 11, 12, wherein the discharge channel is provided with a first outlet which connects to the first collecting location and with a second outlet which connects to the second collecting location; and wherein a sorting and discharge mechanism is provided in the discharge channel for discharging prizes to the first outlet and for discharging playing pieces to the second outlet.

16. The amusement machine of any of the clauses 7-12, wherein the first lift module is provided with a receiving means which can be placed in a first position for receiving playing pieces and prizes in the first collecting location, and can be placed in a second position for dispensing playing pieces and prizes in the infeed location.

17. The amusement machine of clause 16, further comprising operating means controllable by a player and a drive means for moving the receiving means from the first to the second position, which operating means are coupled to the drive means.

18. The amusement machine of any of the clauses 1-17, wherein the transport system comprises an Archimedes screw with a lower end adjacent to a collecting location of the at least one collecting location and an upper end adjacent to an infeed location of the at least one infeed location.

19. The amusement machine of any of the foregoing clauses, wherein a guide is provided between a first infeed location of the at least one infeed location and the playing surface, which guide is configured to guide the one or more playing pieces and/or prizes from the first infeed location to the playing surface.

20. The amusement machine of clause 19, wherein the guide is an inclining surface.

21. The amusement machine of any of the foregoing clauses, wherein the amusement machine is a multiplayer with a plurality of playing surfaces, including the stated playing surface, which plurality of playing surfaces are arranged around a central zone, wherein at least a first collecting location of the at least one collecting location and a first infeed location of the at least one infeed location lie one above the other in the central zone.

22. An amusement machine of the multiplayer pusher type, comprising: a plurality of playing surfaces, wherein a plurality of playing pieces, such as coins, chips or marbles, as well as one or more prizes are supported on each playing surface, wherein the one or more prizes have a form and/or size differing from the form and/or size of a playing piece of the plurality of playing pieces, and for each playing surface a playing piece pusher configured to move over the playing surface at successive points in time in order to disturb the plurality of playing pieces and one or more prizes supported on the playing surface, wherein the playing surface and the playing piece pusher are arranged such that one or more playing pieces and/or prizes can drop over an edge of the playing surface during movement of the playing piece pusher; a transport system with at least one collecting location and at least one infeed location located thereabove, which transport system is configured to collect the one or more playing pieces and prizes which have dropped over the edge in the at least one collecting location, to transport the one or more playing pieces and prizes from the at least one collecting location to the at least one infeed location and to reintroduce the one or more playing pieces and prizes onto the playing surface from the at least one infeed location, wherein the plurality of playing surfaces are located substantially around a central zone, wherein at least a first collecting location of the at least one collecting location and a first infeed location of the at least one infeed location lie one above the other in the central zone.

According to other exemplary embodiments, the amusement machine may be defined according to any one of the following clauses:

1. An amusement machine of the pusher type, comprising: a playing surface on which a plurality of playing pieces, such as coins, chips or marbles, as well as one or more prizes are supported, and a playing piece pusher configured to move over the playing surface at successive points in time in order to disturb the plurality of playing pieces and one or more prizes supported on the playing surface, wherein the playing surface and the playing piece pusher are arranged such that one or more playing pieces and/or prizes can drop over an edge of the playing surface during movement of the playing piece pusher; a transport system comprising: a first collecting location configured to collect prizes and a second collecting location configured to collect playing pieces, said second location being different from said first location, a first infeed location configured for infeed of prizes and a second infeed location configured for infeed of playing pieces, a first lift module configured to transport the prizes collected in the first collecting location to the first infeed location, and a second lift module configured to transport the playing pieces collected in the second collecting location to the second infeed location.

2. The amusement machine of clause 1, wherein the one or more prizes have a shape and/or size differing from the shape and/or size of a playing piece of the plurality of playing pieces.

3. The amusement machine of clause 1 or 2, wherein the prizes are at least two times larger than the playing pieces, and/or wherein the number of playing pieces is at least 10 times greater than the number of prizes, more preferably at least 100 times greater.

4. The amusement of any of the foregoing clauses, wherein the transport system is configured to circulate one or more prizes in a first closed loop comprising the first lift module, and the plurality of playing pieces in a second closed loop comprising the second lift module.

5. The amusement machine of any of the foregoing clauses, further comprising a detection module configured to detect one or more prizes which have dropped over the edge, between the edge and the first collection location, and an award module for awarding a number of prize points to the player in accordance with the detected one or more prizes which have dropped over the edge.

6. The amusement machine of any one of the previous clauses, wherein the first lift module comprises drive means for moving the first lift module vertically upward from the first collecting location to the first infeed location and back, and a control unit for controlling the drive means in accordance with a state of the game.

7. The amusement machine of any one of the previous clauses, wherein the second lift module comprises a hopper module configured to move the playing pieces upward in an orderly row.

8. The amusement machine of any one of the previous clauses, wherein the second lift module comprises a screw of Archimedes configured to move the playing pieces upward in an orderly row.

9. The amusement machine as claimed in any one of the previous clauses, further comprising a sorting and discharge mechanism configured for sorting and discharging the one or more prizes and playing pieces which have dropped over the edge to the first collecting location and the second collecting location, respectively.

10. The amusement machine of clause 9, further comprising a detection module configured to detect one or more prizes which have dropped over the edge, preferably in a discharge channel between the sorting and discharge mechanism and the first collecting location, and an award module for awarding a number of prize points to the player in accordance with the detected one or more prizes which have dropped over the edge.

11. The amusement machine of any one of the previous clauses, further comprising a swing arm at the second infeed location, said swing arm being configured to move over the playing surface, and to guide the playing pieces through the swing arm to an outlet of the swing arm, which outlet is located above the playing surface.

12. The amusement machine of any one of the previous clauses, further comprising a chute at the second infeed location, said chute being configured to guide the playing pieces, preferably marbles, to an outlet of the chute, which outlet is near the playing surface or near a guide leading to the playing surface.

13. The amusement machine of any of the previous clauses, wherein the first lift module is provided with a receiving means which can be placed in a first position for receiving playing pieces and prizes in the first collecting location, and can be placed in a second position for dispensing playing pieces and prizes in the infeed location.

14. The amusement machine of clause 13, further comprising operating means controllable by a player and a drive means for moving the receiving means from the first to the second position, which operating means are coupled to the drive means.

15. The amusement machine of any of the previous clauses, wherein the first and/or second lift module comprises an Archimedes screw with a lower end adjacent to the first and/or second collecting location and an upper end adjacent to the first and/or second infeed location.

16. The amusement machine of any of the foregoing clauses, wherein a guide is provided between the first infeed location and the playing surface, which guide is configured to guide the one or more prizes from the first infeed location to the playing surface.

17. The amusement machine of clause 16, wherein the guide is an inclining surface.

18. The amusement machine of any of the foregoing clauses, wherein the amusement machine is a multiplayer with a plurality of playing surfaces, including the stated playing surface, which plurality of playing surfaces are arranged around a central zone, wherein the first collecting location and the first infeed location lie one above the other in the central zone.

According to exemplary embodiments, the amusement machine may be defined according to any one of the following clauses:

1. An amusement machine of the pusher type, comprising: a playing surface on which a plurality of playing pieces, such as coins, chips or marbles, as well as one or more prizes are supported, wherein the one or more prizes have a shape and/or size differing from the shape and/or size of a playing piece of the plurality of playing pieces, and a playing piece pusher configured to move over the playing surface at successive points in time in order to disturb the plurality of playing pieces and one or more prizes supported on the playing surface, wherein the playing surface and the playing piece pusher are arranged such that one or more playing pieces and/or prizes can drop over an edge of the playing surface during movement of the playing piece pusher; wherein the one or more prizes comprise a transparent casing in which a valuable object and an identification means are arranged.

2. The amusement machine of clause 1, wherein the valuable object comprises cash money.

3. The amusement machine of clause 1 or 2, wherein the identification means comprises an RFID tag.

4. The amusement machine of any of the foregoing clauses, further comprising a detection module configured to detect one or more prizes which have dropped over the edge, and an award module for awarding a number of prize points to the player in accordance with the detected one or more prizes which have dropped over the edge.

5. The amusement of any of the foregoing clauses, further comprising a transport system with a collecting location for collecting the prizes which have dropped over the edge, and at least one infeed location which lies higher than the collecting location, which transport system is configured to reintroduce the one or more prizes onto the playing surface from the at least one infeed location; wherein the transport system is configured to transport the one or more prizes from the at least one collecting location to the at least one infeed location.

6. The amusement machine of clause 5, wherein the collecting location is configured to collect playing pieces and prizes, and wherein the infeed location is configured to collect playing pieces and prizes.

7. The amusement machine of clause 5 of 6, wherein a lift module configured for transport of the prizes is provided between the collecting location and the infeed location.

8. The amusement machine of any of the previous clauses, further comprising a second collecting location configured to collect playing pieces without prizes, and a second infeed location configured for infeed of playing pieces.

9. The amusement machine of clause 8, further comprising a sorting and discharge mechanism configured for sorting and discharging the one or more prizes and playing pieces which have dropped over the edge to the collecting location and the second collecting location, respectively.

10. The amusement machine of clause 8 or 9, further comprising a second lift module configured to transport the playing pieces collected from the second collecting location to the second infeed location.

11. The amusement machine of clause 10, wherein the second lift module comprises a hopper module or an Archimedes screw configured to move the playing pieces upward in an orderly row.

12. The amusement machine of any one of the clauses 8-11, further comprising a swing arm at the second collecting location and which is configured to move over the playing surface, which swing arm is further configured to guide the playing pieces through the swing arm to an outlet of the swing arm, which outlet is located above the playing surface.

13. The amusement machine of any of the foregoing clauses, comprising a discharge channel between the edge of the playing surface and the collecting location, which discharge channel has an inlet into which drop the prizes which have dropped over the edge, and has at least one outlet which connects to the collecting location, wherein the detection module is provided along the discharge channel for detecting one or more prizes in the discharge channel.

14. The amusement machine of clause 7 and any one of the previous claims, wherein the lift module is provided with a receiving means which can be placed in a first position for receiving prizes in the collecting location, and can be placed in a second position for dispensing prizes in the infeed location.

15. The amusement machine of any of the foregoing clauses, wherein a guide is provided between the infeed location and the playing surface, which guide is configured to guide at least the one or more prizes from the infeed location to the playing surface.

16. The amusement machine of clause 15, wherein the guide is an inclining surface.

17. The amusement machine of any of the foregoing clauses, wherein the amusement machine is a multiplayer with a plurality of playing surfaces, including the stated playing surface, which plurality of playing surfaces are arranged around a central zone, wherein the collecting location and the infeed location lie one above the other in the central zone.

According to other exemplary embodiments, the amusement machine may be defined according to any one of the following clauses:

1. An amusement machine of the pusher type, comprising: a playing surface on which a plurality of playing pieces, such as coins, chips or marbles, as well as one or more prizes are supported, and a playing piece pusher configured to move over the playing surface at successive points in time in order to disturb the plurality of playing pieces and one or more prizes supported on the playing surface, wherein the playing surface and the playing piece pusher are arranged such that one or more playing pieces and/or prizes can drop over an edge of the playing surface during movement of the playing piece pusher; a transport system comprising: a first collecting location configured to collect prizes, a first infeed location configured for infeed of prizes, a first transport mechanism configured to transport the prizes collected in the first collecting location to the first infeed location; a detection module configured to detect one or more prizes which have dropped over the edge, between the edge and the first collection location; a control unit for controlling the transport mechanism in function of the prizes detected by the detection means, and in particular the number of prizes detected by the detection means.

2. The amusement machine of clause 1, wherein the transport system further comprises a second collecting location configured to collect playing pieces, said second location being different from said first location, a second infeed location configured for infeed of playing pieces, and a second transport mechanism configured to transport the playing pieces collected in the second collecting location to the second infeed location.

3. The amusement machine of clause 1 or 2, wherein the one or more prizes have a shape and/or size differing from the shape and/or size of a playing piece of the plurality of playing pieces; and/or wherein the prizes are at least two times larger than the playing pieces, and/or wherein the number of playing pieces is at least 10 times greater than the number of prizes, more preferably at least 100 times greater.

4. The amusement of any of the foregoing clauses, wherein the transport system is configured to circulate one or more prizes in a first closed loop comprising the first lift module, and the plurality of playing pieces in a second closed loop comprising the second lift module.

5. The amusement machine of any of the foregoing clauses, further comprising an award module for awarding a number of prize points to the player in accordance with the detected one or more prizes which have dropped over the edge 6. The amusement machine of any one of the previous clauses, wherein the first transport mechanism comprises drive means for moving a first lift module vertically upward from the first collecting location to the first infeed location and back, and wherein the control unit is configured for controlling the drive means in accordance with a state of the game.

7. The amusement machine of any one of the previous clauses, wherein the second transport mechanism comprises a hopper module configured to move the playing pieces upward in an orderly row.

8. The amusement machine of any one of the previous clauses, wherein the second transport mechanism comprises a screw of Archimedes configured to move the playing pieces upward in an orderly row.

9. The amusement machine as claimed in any one of the previous clauses, further comprising a sorting and discharge mechanism configured for sorting and discharging the one or more prizes and playing pieces which have dropped over the edge to the first collecting location and the second collecting location, respectively.

10. The amusement machine of clause 9, wherein the detection module is configured to detect one or more prizes which have dropped over the edge, preferably in a discharge channel between the sorting and discharge mechanism and the first collecting location.

11. The amusement machine of any one of the previous clauses, wherein the second transport mechanism comprises a swing arm, said swing arm being configured to move over the playing surface, and to guide the playing pieces through the swing arm to an outlet of the swing arm, which outlet is located above the playing surface.

12. The amusement machine of any one of the previous clauses, wherein the second transport mechanism comprises a chute, said chute being configured to guide the playing pieces, preferably marbles, to an outlet of the chute, which outlet is near the playing surface or near a guide leading to the playing surface.

13. The amusement machine of any of the previous clauses, wherein the first transport mechanism is provided with a receiving means which can be placed in a first position for receiving playing pieces and prizes in the first collecting location, and can be placed in a second position for dispensing playing pieces and prizes in the infeed location.

14. The amusement machine of clause 13, further comprising operating means controllable by a player and a drive means for moving the receiving means from the first to the second position, which operating means are coupled to the drive means.

15. The amusement machine of any of the foregoing clauses, wherein a guide is provided between the first infeed location and the playing surface, which guide is configured to guide the one or more prizes from the first infeed location to the playing surface.

16. The amusement machine of clause 15, wherein the guide is an inclining surface.

17. The amusement machine of any of the foregoing clauses, wherein the amusement machine is a multiplayer with a plurality of playing surfaces, including the stated playing surface, which plurality of playing surfaces are arranged around a central zone, wherein the first collecting location and the first infeed location lie one above the other in the central zone.

BRIEF DESCRIPTION OF THE DRAWINGS

The present invention will be further elucidated on the basis of a number of by no means limitative exemplary embodiments with reference to the accompanying drawings, in which.

DETAILED DESCRIPTION OF THE INVENTION

Figure 1:
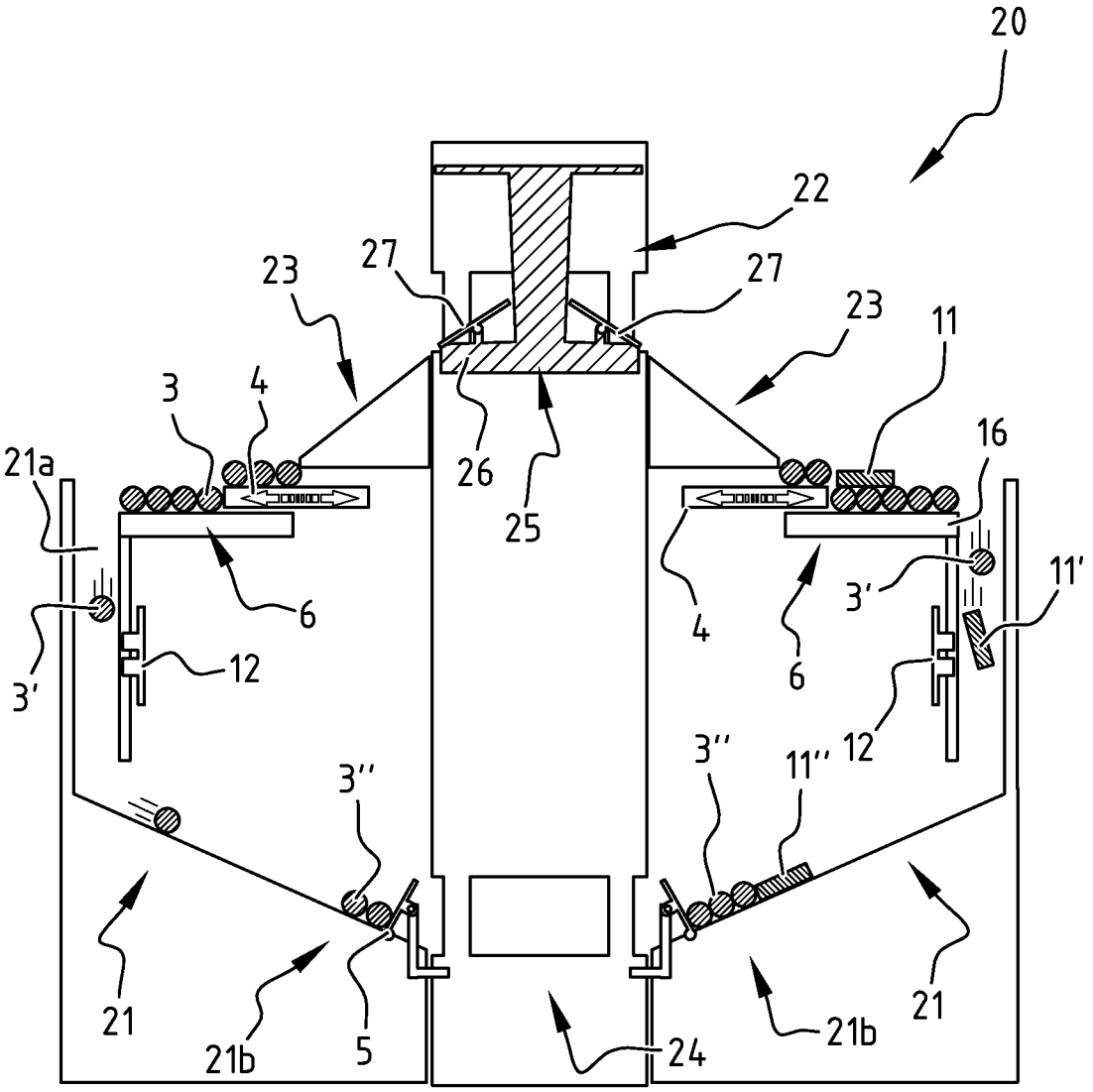
FIGS. 1-3 illustrate schematically a first embodiment of an amusement machine according to the invention in different positions of the lift module.
Figure 2:
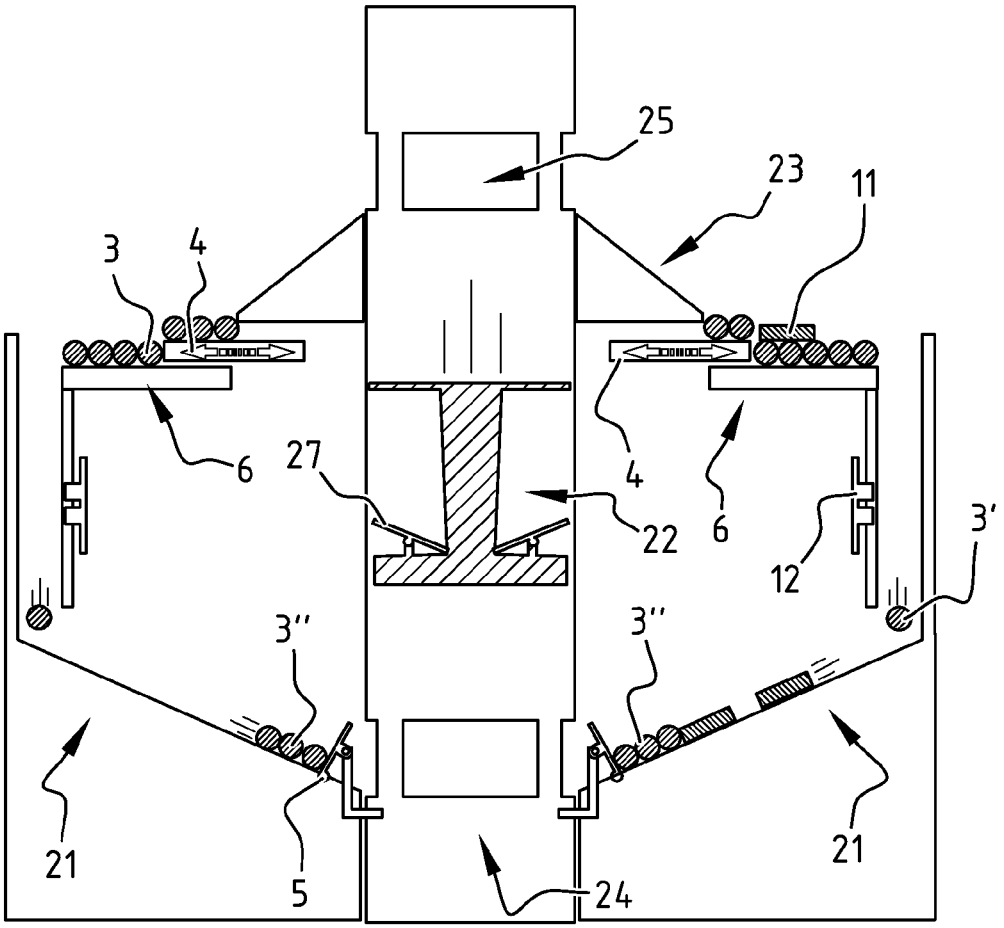
Figure 3:
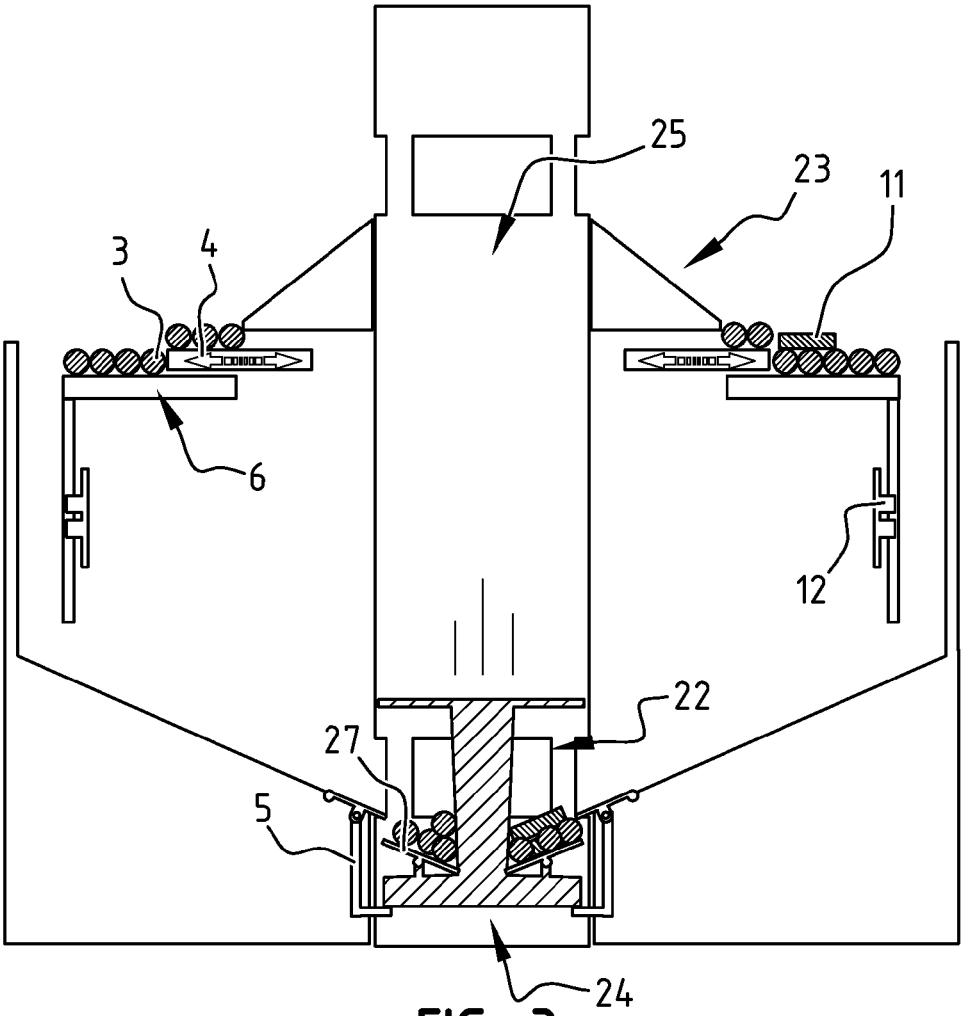

FIGS. 1-3 illustrate a first embodiment of an amusement machine of the pusher type according to the invention in different positions of lift module 22, see below. In the embodiment of FIGS. 1-3 the amusement machine is a so-called multiplayer, for instance a six-player with six playfields 6. Two playfields or playing surfaces 6 can be seen in FIGS. 1-3. FIGS. 1-3 are schematic cross-sections of the machine, and the skilled person will appreciate that the multiplayer can for instance be a two-player, a three-player, a four-player, a six-player and so on. It is further also possible to provide only one playfield 6, wherein the left or right half of FIG. 1 (and FIG. 2 and FIG. 3) is then omitted.

The amusement machine comprises a playing piece pusher 4 for each playing surface 6. Playing surface 6 is typically a horizontal surface on which are supported a plurality of playing pieces 3, such as coins, chips or marbles, as well as a number of prizes 11. If marbles are used for gameplay, playing surface 6 can for instance be provided with corrugations. Note that playing surface 6 need not necessarily be horizontal, and can also be placed at a slight angle of inclination. Prizes 11 are typically considerably larger than playing pieces 3, and there are considerably fewer prizes 11 than playing pieces 3, for instance less than one prize 11 per hundred playing pieces 3. The playing piece pusher 4 is configured to move over playing surface 6 at successive points in time in order to disturb the plurality of playing pieces 3 and prizes 11 supported on playing surface 6. During movement of the playing piece pusher 4 one or more playing pieces 3 and/or prizes 11 can drop over an edge 16 of playing surface 6, see reference numerals 3' and 11'. The playing piece pusher 4 can for instance be a plate (box) which moves reciprocally over playfield 6 in the direction of edge 16. In the case of a multiplayer the playing piece pusher can also be one central plate or box which moves over the different playing surfaces 6 of the multiplayer.

The amusement machine further comprises a transport system 20 with a lift module 22. Transport system 20 is configured to collect the one or more playing pieces 3 and prizes 11 which have dropped over edge 16 in a collecting location 24 for the purpose of transporting the one or more playing pieces 3 and prizes 11 from collecting location 24 to a higher infeed location 25 and for reintroducing the one or more playing pieces 3 and prizes 11 onto playing surface 6 from the higher infeed location 25. In FIG. 3 lift module 22 is in a low position, in which the playing pieces 3 and prizes 11 which have dropped over edge 16 come to lie in collecting location 24. In FIG. 1 lift module 22 is in a high position, in which playing pieces and prizes which have been carried upward can be reintroduced onto playfield 6 from infeed location 25.

Transport system 20 comprises a discharge channel 21 which extends between edge 16 of playing surface 6 and collecting location 24, and a guide 23 between infeed location 25 and playing surface 6. Discharge channel 21 has an inlet 21*a* into which drop the one or more playing pieces 3 and/or prizes 11 which have dropped over the edge, see reference numerals 3' and 11', and an outlet 21*b* which connects to collecting location 24. A closing means such as a gate 5 can be provided between outlet 21*b* and collecting location 24 for temporarily holding back one or more playing pieces 3" and prizes 11".

Lift module 22 is provided with a base 26 on which a tiltable receiving means 27 is provided for each playing surface 6. Receiving means 27 is configured to receive one or more playing pieces 3 and/or prizes 11. As shown in FIG. 3, gates 5 can be opened when lift module 22 is in the low position, whereby one or more playing pieces 3 and/or prizes 11 come to lie in tiltable receiving means 27 at collecting location 24. Receiving means 27 can for instance consist of a tiltable receptacle with an open end through which the playing pieces and prizes can be received in the receptacle. Once one or more playing pieces 3 and/or prizes 11 have been received, lift module 22 can be moved upward, see FIG. 2, and gates 5 are closed. When lift module 22 reaches the high position which corresponds to the higher infeed location 25, receptacles 27 can be tilted such that the one or more playing pieces 3 and/or prizes 11 are released and can be reintroduced onto playing surface 6 via inclining surface 23.

The amusement machine further comprises a detection module 12 configured to detect one or more prizes 11" which have dropped over the edge. Detection module 12 can for instance be an RFID reader module and prizes 11 can for instance be provided with an RFID tag which is readable by the RFID reader module.

The game can be made more attractive to a player by providing different prizes 11 on playing surface 6, on top of playing pieces 3. These prizes 11 are preferably considerably larger than playing pieces 3 such that they are easily recognizable by the user. The prizes can for instance have an readily identifiable shape and colour. In contrast to prior art solutions, prizes 11 can circulate in embodiments according to the present invention in a so-called closed loop in the amusement machine. In embodiments of the present invention both playing pieces 3 and prizes 11 can thus circulate in a closed loop in the amusement machine. Prizes 11 are pushed together with playing pieces 3 over the edge 16 of playing surface 6 and are detected in discharge channel 21 by detection module 12. Detection module 12 can co-act with an award module for awarding a number of prize points to the player in accordance with the detected prize 11. In the illustrated embodiment detection module 12 is provided close to inlet 21*a*, although the skilled person will appreciate that detection module 12 can also be provided close to outlet 21*b* or close to edge 16, or in lift module 22. Following detection of prize 11 the one or more pieces 3 and prizes 11 can slide in the direction of gate 5, wherein the gate can be opened as soon as lift module 22 is in the low collecting location 24. Gate 5 can be opened automatically when lift module 22 arrives at the low position, after which the one or more prizes 11 and/or playing pieces 3 slide into receptacles 27 and lift module 22 can be moved to the higher infeed location 25. At the higher infeed location 25 receptacle 27 can be tilted automatically and the one or more prizes 11 and/or playing pieces 3 can slide over incline 23 to playing surface 6. The one or more prizes 11 and/or playing pieces 3 come to lie on playing surface 6 by moving the pusher 4, and the cycle begins again.

An advantage of embodiments of the present invention is that the closed loop transport system is configured to use any form of prizes 11 and any type of playing piece 3, for instance coins, chips or marbles, the only condition being that they have to fit in receptacles 27. An operator of the amusement machine can present a game which is attractive to the player and which requires no or hardly any assistance in refilling the amusement machine and/or reading prizes 11.

Figure 4:
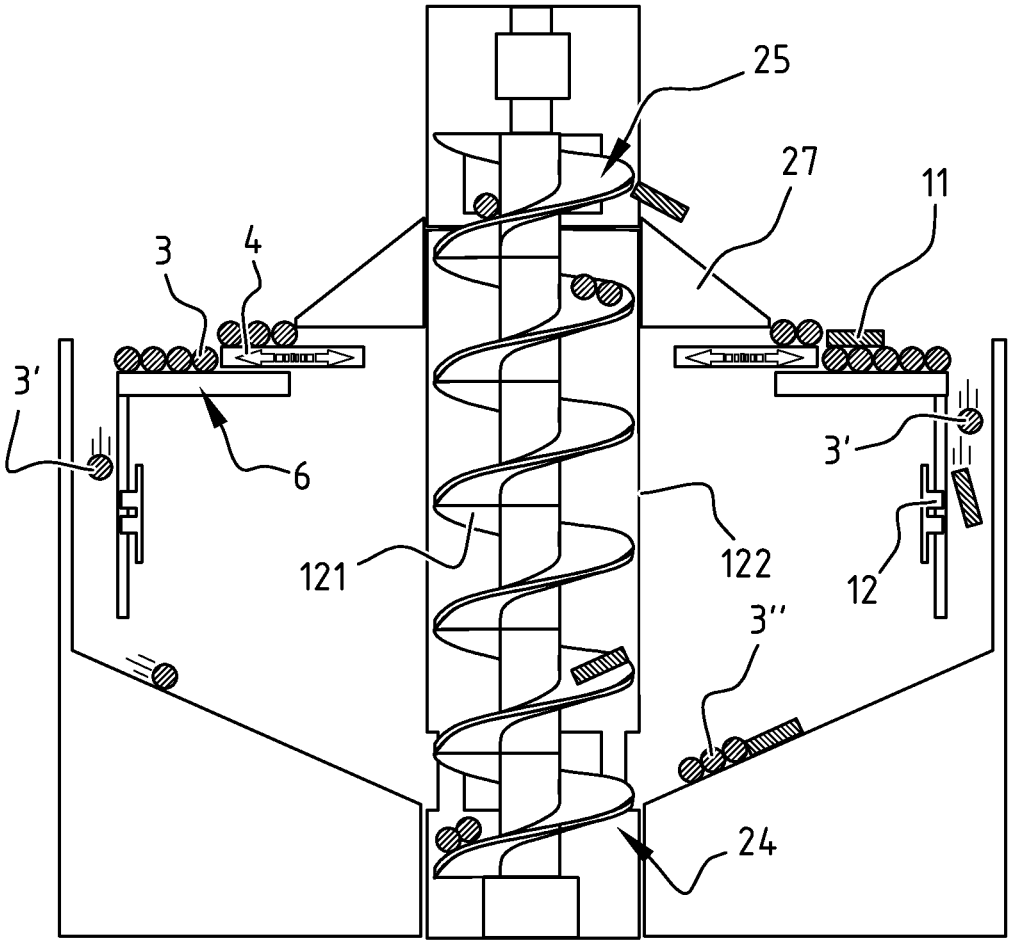
FIG. 4 illustrates schematically a second embodiment of an amusement machine according to the invention.

FIG. 4 illustrates a second embodiment of an amusement machine of the pusher type according to the invention. This embodiment is similar to the embodiment of FIGS. 1-3, with the difference that the lift module consists of an Archimedes screw 121, 122. In such an embodiment it is not necessary to provide gates 5, and the Archimedes screw 121, 122 functions as the receiving means for receiving the one or more playing pieces 3 and/or prizes 11. Playing pieces 3 and prizes 11 are collected in collecting location 24 and transported upward by screw 121 which rotates in cylinder 122. When prizes 11 and playing pieces 3 reach the higher infeed location 24, they can be carried back onto playfield 6 via inclines 27.

Figure 5:
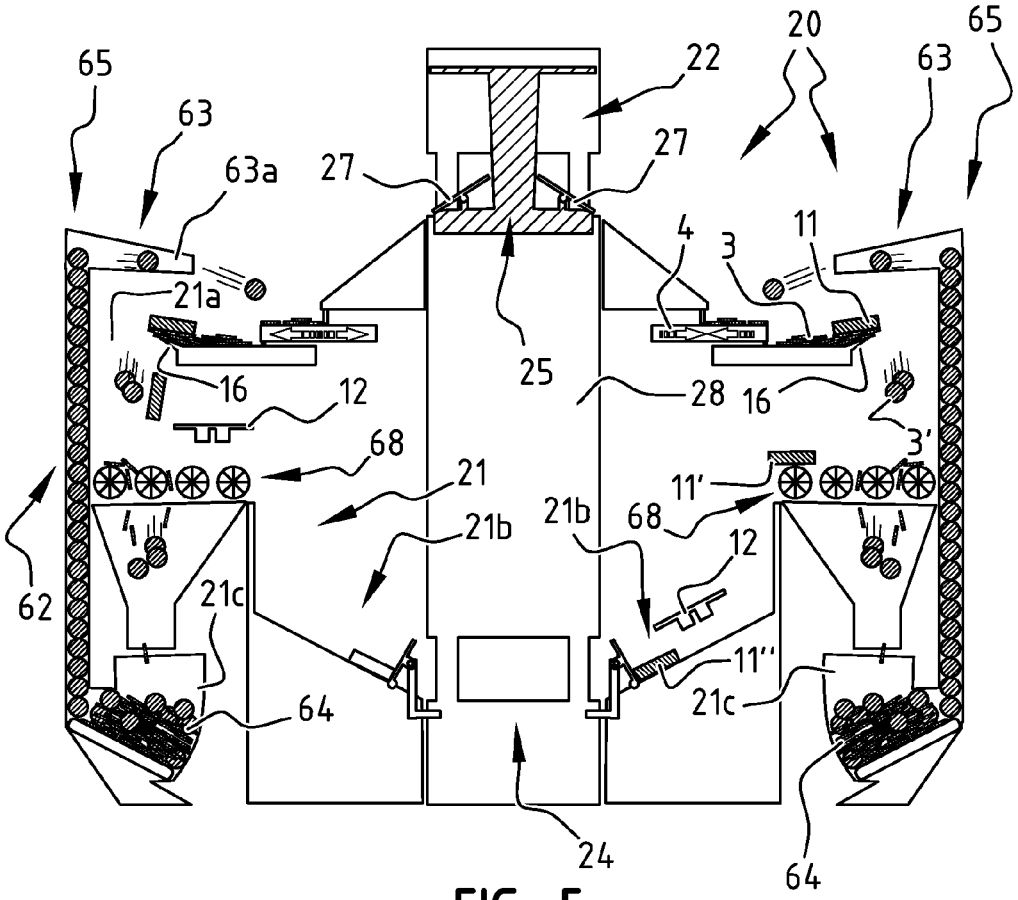
FIGS. 5-7 illustrate schematically a third embodiment of an amusement machine according to the invention in different positions of the lift module.
Figure 6:
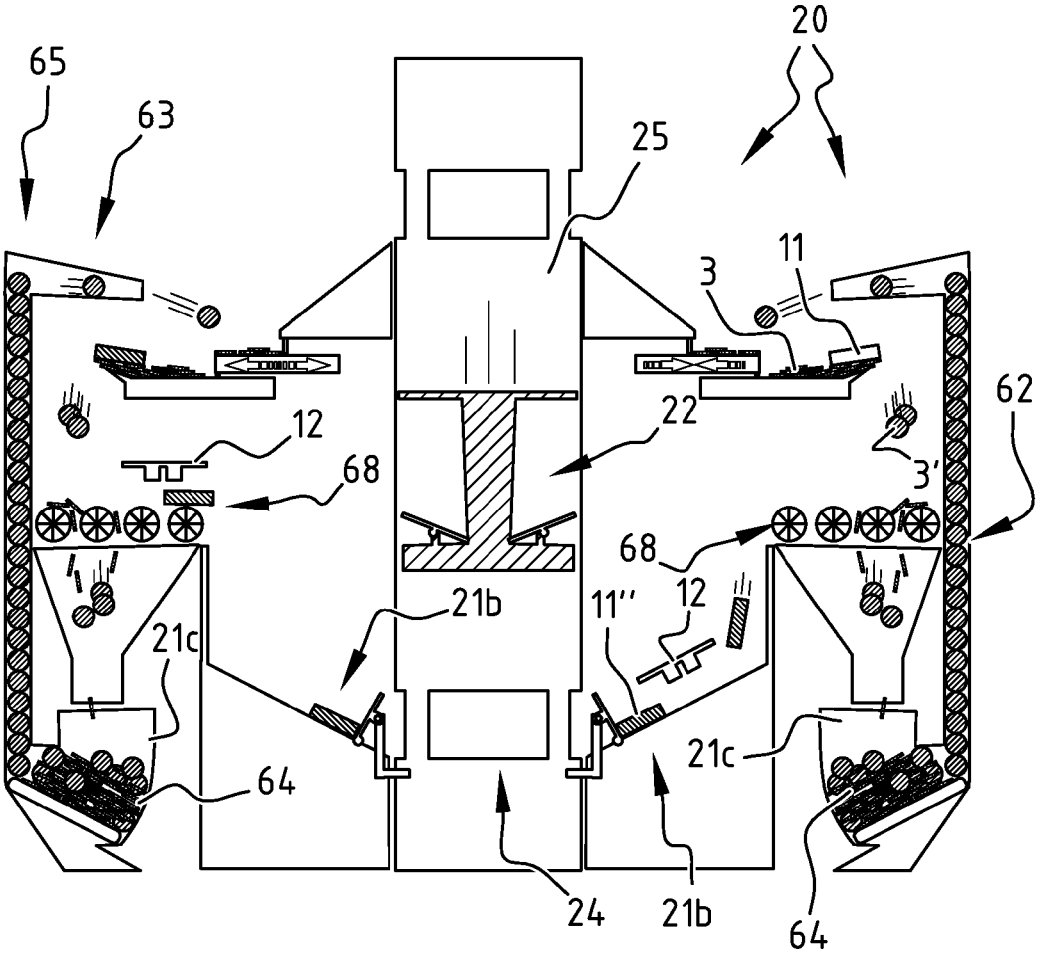
Figure 7:
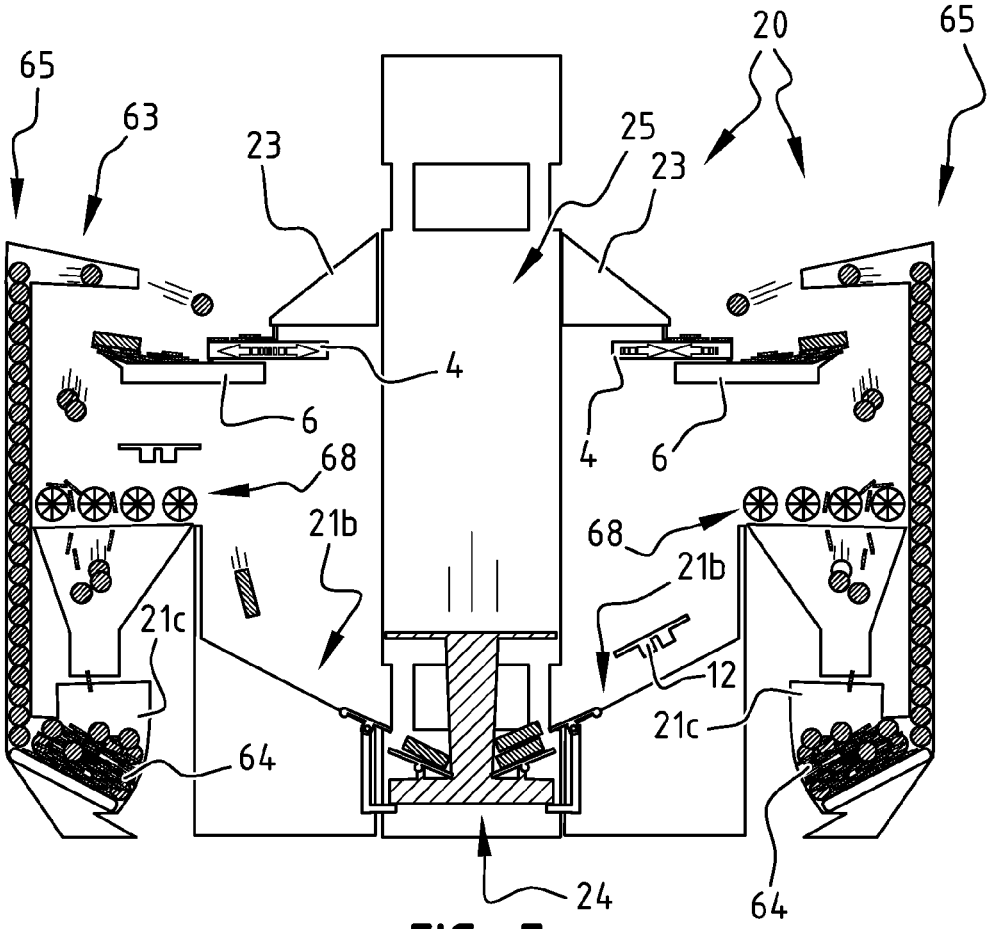

FIGS. 5-7 illustrate a third embodiment of the amusement machine according to the invention, where the same reference numerals are used to refer to the same or similar components. Provided in this embodiment are a first collecting location 24 configured to collect prizes 11 without playing pieces 3 and a second collecting location 64 configured to collect playing pieces 3 without prizes 11. Further provided are a first infeed location 25 configured for infeed of prizes 11 without playing pieces 3 and a second infeed location 65 configured for infeed of playing pieces 3 without prizes 11. Provided between the first collecting location 24 and the first infeed location 25 is a first lift module 22 configured to transport the prizes 11 collected in the first collecting location and provided between the second collecting location 64 and the second infeed location 65 is a second lift module 62 configured to transport the playing pieces 3 collected in the second collecting location.

The first lift module 22 comprises drive means (not shown) for moving lift module 22 vertically upward from the first collecting location 24 to the first infeed location 25 and back, and a control unit (not shown) for controlling the drive means in accordance with a state of the game, for instance when a player still has sufficient credits. The second lift module 62 comprises a hopper module, for instance an escalator hopper, which is configured to move playing pieces 3 upward in an orderly row from the second collecting location 64 to the second infeed location 65. Playing piece counting means (not shown) can optionally be provided in hopper module 62 for counting the number of playing pieces. This counted number can then be passed on to a control module (not shown) for awarding extra credits or points to the player. Provided at the second infeed location is a swing arm 63 which connects to the second infeed location 65 and is configured to move over playing surface 6. Swing arm 63 is further configured to guide playing pieces 3 through swing arm 63 and to an outlet 63*a* of swing arm 63, which outlet 63*a* is located above playing surface 6. Operating means such as a button and a joystick can further be provided for control of swing arm 63 by a player.

Transport system 20 comprises a discharge channel 21 between edge 16 of playing surface 6 and first and second collecting locations 24, 64. Discharge channel 21 has an inlet 21*a* into which drop the one or more playing pieces 3 and prizes 11 which have dropped over the edge, and a first outlet 21*b* which connects to the first collecting location 24 and a second outlet 21*c* which connects to the second collecting location 64. Provided in discharge channel 21 is a sorting and discharge mechanism 68 for discharging prizes 11' to first outlet 21*b* and for discharging playing pieces 3' to second outlet 21*c*. Sorting and discharge mechanism 68 comprises for instance a number of mutually spaced rollers through which the smaller playing pieces drop downward in the direction of the second collecting location 64 and over which the larger prizes 11' are transported to first outlet 21*b*. Detection module 12 can for instance be provided along discharge channel 21, above sorting and discharge mechanism 68, for detecting one or more prizes 11 in discharge channel 21.

First lift module 22 is provided with a receiving means 27 which can be placed in a first position for receiving prizes 11 in the first collecting location 24 and can be placed in a second position for dispensing prizes 11 at the first infeed location 25. The machine further comprises operating means (not shown) controllable by a player and a drive means for moving receiving means 27 from the first to the second position, which operating means are preferably coupled to the drive means such that a player can determine when the receiving means tilts.

The skilled person will appreciate that transport system 20 can also be implemented in other ways. The transport system can thus consist of a plurality of mutually connecting conveyor belts, wherein the lift system can for instance be a conveyor belt running upward. One of the advantages of the transport systems illustrated in FIGS. 1-7 is that they are compact and can be built centrally into a multiplayer in simple manner. In addition, it is also possible to provide two parallel lift modules centrally, a first for playing pieces 3 and a second for prizes 11, wherein playing pieces 3 and prizes are pre-sorted. Additional infeed means controllable by a user could then be provided which allow the timing of the reintroduction of playing pieces 3/prizes 11 to be influenced.

Figure 9:
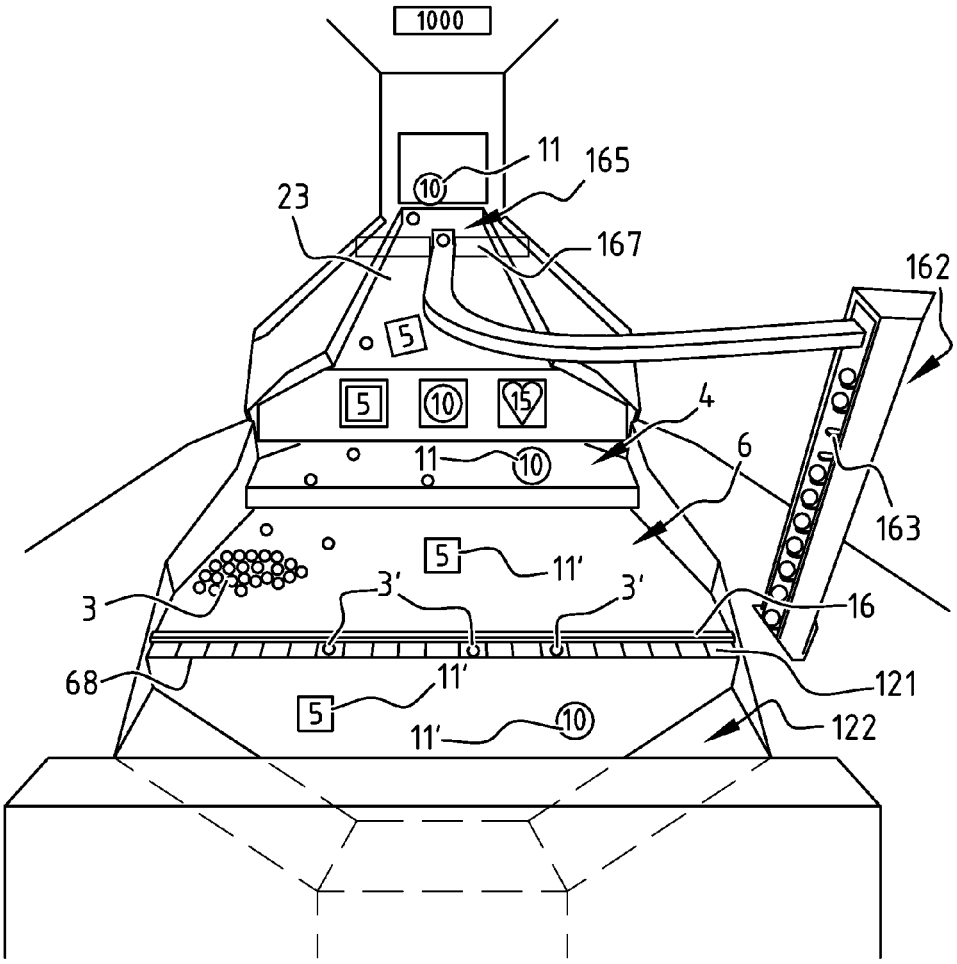
FIGS. 9 and 10 illustrate schematically a third embodiment of an amusement machine according to the invention.
Figure 10:
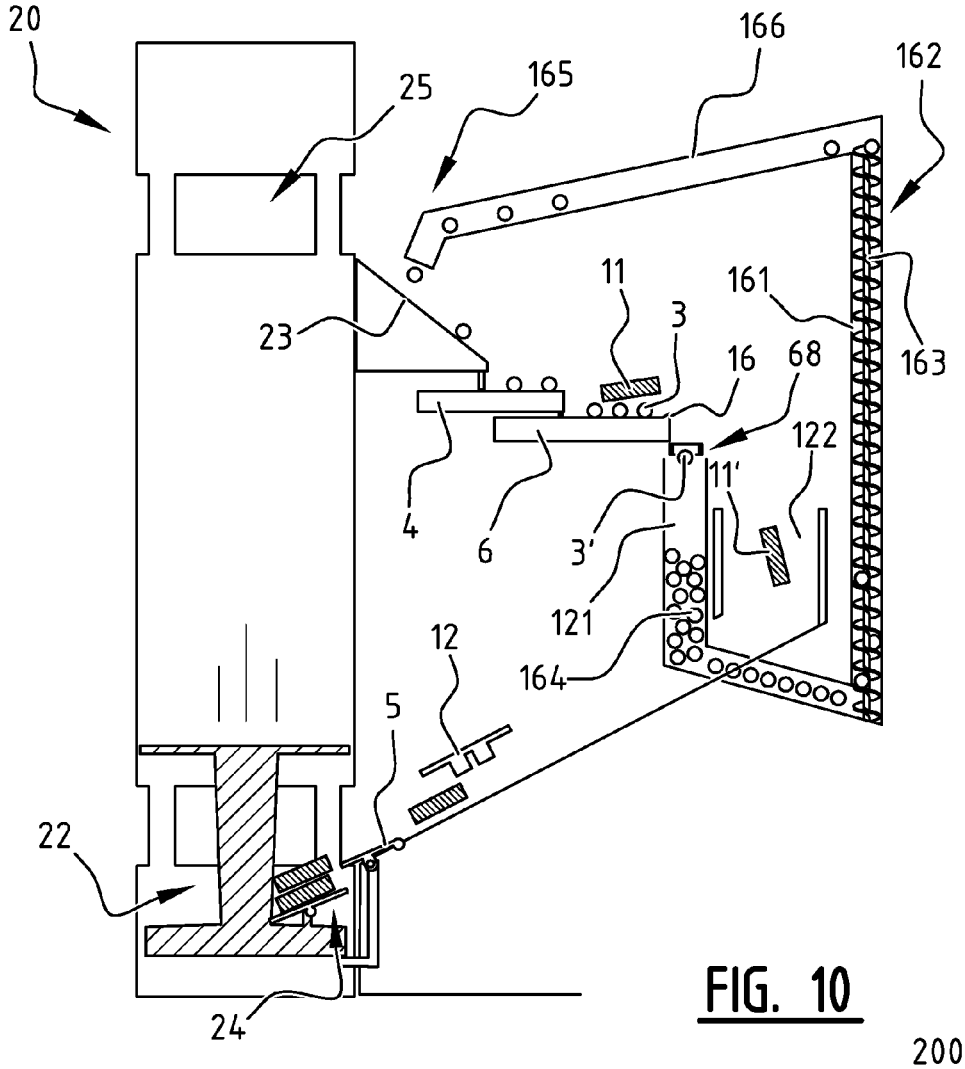

FIGS. 9 and 10 illustrate schematically a third embodiment of an amusement machine of the pusher type according to the invention which is particularly useful when using marbles as playing pieces. In the embodiment of FIGS. 9 and 10 the figures show one play area of a multiplayer, for instance a six-player with six playfields 6. The skilled person will appreciate that the multiplayer can for instance be a two-player, a three-player, a four-player, a six-player and so on. It is further also possible to provide only one playfield 6, wherein the left or right half of FIG. 1 (and FIG. 2 and FIG. 3) is then omitted.

The amusement machine comprises a playing piece pusher 4 for each playing surface 6. Playing surface 6 is typically a horizontal surface on which are supported a plurality of playing pieces 3, such as marbles, as well as a number of prizes 11. If marbles are used for gameplay, playing surface 6 can for instance be provided with corrugations. Note that playing surface 6 need not necessarily be horizontal, and can also be placed at a slight angle of inclination. Prizes 11 are typically considerably larger than playing pieces 3, and there are considerably fewer prizes 11 than playing pieces 3, for instance less than one prize 11 per hundred playing pieces 3. In the illustrated embodiment the prizes 11 are square, round and heart shaped objects having a different color and being provided with a indication of the points associated with the prize, e.g. a blue square object associated with 5 points, a green round object associated with 10 points, and a red heart shaped object associated with 15 points. The playing piece pusher 4 is configured to move reciprocally over playfield 6 in the direction of edge 16 at successive points in time in order to disturb the plurality of playing pieces 3 and prizes 11 supported on playing surface 6. During movement of the playing piece pusher 4 one or more playing pieces 3 and/or prizes 11 can drop over an edge 16 of playing surface 6, see reference numerals 3' and 11'.

The amusement machine comprises a transport system 20 with a first closed transport loop for prizes 11 and with a second closed loop for playing pieces 3. The transport system 20 comprises a sorting and discharge mechanism 68 for discharging playing pieces 3' to a second discharge channel 121, and for discharging prizes 11' to a first discharge channel 122. The sorting and discharge mechanism 68 may be an elongate grid with suitable mesh dimensions such that the playing pieces 3' fall through the grid 68 into the second discharge channel 121 and the prizes 11' pass over the grid 68 into the first discharge channel 122. The grid 68 extends along the edge 16 of the playing surface 6, and the second discharge channel 121 is located below the grid 68. The first discharge channel 122 is located in front of the second discharge channel 121 such that prizes 11' passing over grid 68 fall into the first discharge channel 122. Typically the mesh dimensions will be smaller than the dimensions of a prize 11 and bigger than the dimensions of a playing piece 3.

The first discharge channel 122 has an outlet which connects to a first collecting location 24. The second discharge channel 121 has an outlet which connects to a second collecting location 164. Provided between first collecting location 24 and first infeed location 25 is a first lift module 22 (see FIG. 10) configured to transport the prizes 11 collected in first collecting location 24. When first lift module 22 is in a low position, prizes 11 which have dropped over edge 16 come to lie in first collecting location 24. When first lift module 22 is in a high position prizes which have been carried upward can be reintroduced onto playfield 6 from first infeed location 25. A closing means such as a gate 5 (see also FIG. 1) can be provided between outlet of first discharge channel 122 and first collecting location 24 for temporarily holding back one or more prizes. First lift module 22 may be implemented as described above for the embodiment of FIGS. 5-7.

A detection module 12 can for instance be provided along first discharge channel 122, after sorting and discharge mechanism 68, for detecting one or more prizes 11 in first discharge channel 122. Detection module 12 can for instance be an RFID reader module, and prizes 11 can for instance be provided with an RFID tag which is readable by the RFID reader module.

Provided between second collecting location 164 and a second infeed location 165 is a second lift module 162 configured to transport playing pieces 3 collected in second collecting location 164. The second lift module 162 may comprise an Archimedes screw 163. The Archimedes screw 163 functions as the receiving means for receiving the one or more playing pieces 3, preferably marbles. Playing pieces 3 are collected in second collecting location 164 and transported upward by screw 163 which rotates in a cylinder 161. When playing pieces 3 reach the top of the second lift module 162, they can be carried back onto playfield 6 via a chute 166 which is configured to dispense the playing pieces 3 on the inclined surface 23. The playing pieces 3 slide or roll on the inclined surface 23, on the playfield 6 via pusher 4. Optionally there may be provided a guide piece 167 at a distance above the inclined surface 23 to ensure that playing pieces 3 follow the incline 23 as they move towards the playfield 6.

In contrast to prior art solutions, prizes 11 can circulate in the third embodiment in a first closed loop in the amusement machine, via first discharge channel 122 and first lift module 22. Prizes 11 are pushed together with playing pieces 3 over the edge 16 of playing surface 6, are sorted by grid 68, and are detected in first discharge channel 122 by detection module 12. Detection module 12 can co-act with an award module for awarding a number of prize points to the player in accordance with the detected prize 11. Following detection of a prize 11, the prize 11 slides in the direction of gate 5, wherein the gate can be opened as soon as the first lift module 22 is in the low first collecting location 24. The one or more prizes 11 slide into the first lift module 22 and first lift module 22 is moved to the higher first infeed location 25. At the higher first infeed location 25 the one or more prizes 11 can slide over incline 23 to playing surface 6. The one or more prizes 11 come to lie on playing surface 6 by moving the pusher 4, and the cycle begins again.

Playing pieces 3 circulate in a second closed loop, via second discharge channel 121, second lift module 162 and chute 166.

The first lift module 22 comprises drive means (not shown) for moving first lift module 22 vertically upward from the first collecting location 24 to the first infeed location 25 and back, and a control unit (not shown) for controlling the drive means in accordance with a state of the game, for instance when a player still has sufficient credits. The second lift module 162 with screw 163 is configured to move playing pieces 3 upward in an orderly row from the second collecting location 164 to the second infeed location 165. Playing piece counting means (not shown) can optionally be provided for counting the number of playing pieces. This counted number can then be passed on to a control module (not shown) for awarding extra credits or points to the player. Operating means such as a button and a joystick can further be provided for controlling the adding of playing pieces 3 by a player via the screw 163 and chute 166.

In an exemplary embodiment the control module is configured to operate the first lift module 22 when a predetermined number of prizes has been collected in the first collection location 24, e.g. 5 prizes. When the predetermined number of prizes has been collected, the gate 5 is closed and the first lift module is moved upwardly to dispense the prizes from the first infeed location 25 back on the playing surface 26. The control module is further connected with the operator means, such as a button and/or a joystick, and is configured to control the adding of a playing piece in function of the inputs of the player input via the operator means. E.g. whenever the player presses a button, a playing piece is added on the playing surface 6.

Figure 11:
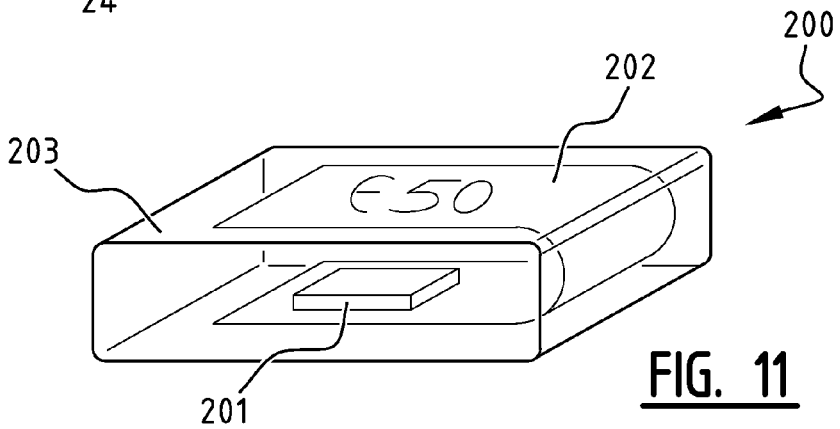
FIG. 11 illustrates an exemplary embodiment of a prize of the invention.

FIG. 11 illustrates an exemplary embodiment of a prize which may be used in amusement machines of the invention. The prize 200 comprises a transparent casing in which a valuable object 202, here a 50 EUR banknote, and identification means, e.g. an RFID tag 201. Including a valuable object 202 in a transparent casing, has the advantage that the prize can be easily manipulated within a closed loop in the amusement machine, and that the player sees a real prize. By including an RFID tag 201 the prize 202 can be identified by an RF ID reader, described in the various embodiments as detection means 12, and a player may receive a ticket on which the prize is indicated through payment means of the amusement machine. With this ticket he may then collect the real prize.

The skilled person will also appreciate that, instead of two platforms (playfield 6 and pusher 4), more than two platforms can also be provided, wherein one or more of the platforms are movable.

Figure 8:
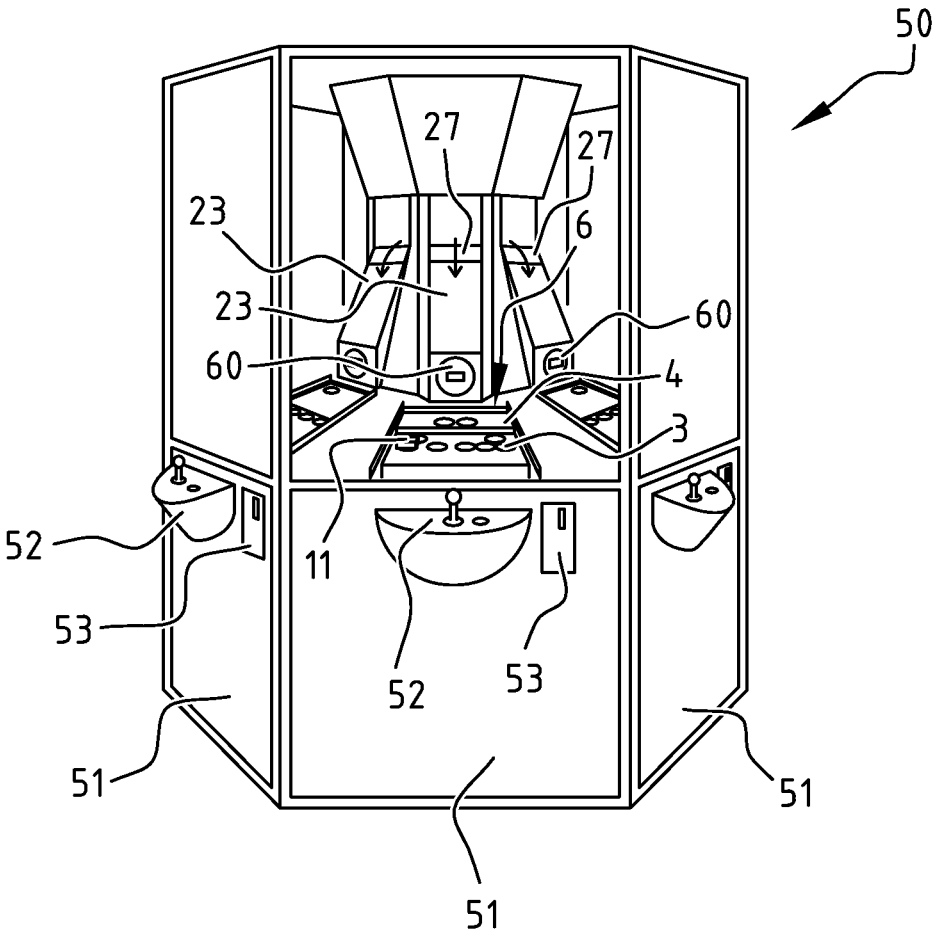
FIG. 8 illustrates schematically a perspective view of a fourth embodiment of an amusement machine according to the invention.

Finally, FIG. 8 illustrates a schematic perspective view of a multiplayer intended for six players and comprising six playing surfaces 6. This amusement machine can further be configured as described in the first embodiment of FIGS. 1-3, or as described in the second embodiment of FIG. 4, or as described in the third embodiment of FIGS. 5-7, or as described in the fourth embodiment of FIGS. 9-10. The multiplayer comprises a housing with six side walls 51, an upper part of which takes a transparent form in each case in order to make the associated playfield 6 visible. Side walls 51 are typically provided with operating means 52 for adding a playing piece 3 on playfield 6 and/or for moving an additional arm (not shown) with which playing pieces 3 can be thrown onto playfield 6. These operating means can for instance comprise a button and a joystick. In the embodiment of FIGS. 5-7 the joystick and the button can be configured to move the swing arm. A display screen 60 is further provided above each playfield 6. The credits of a player can for instance be stated on this display screen. A payment module 53 is further provided in each wall 51. This payment module 53 can for instance be configured for purchase of credits with cash (coins and/or notes) or for purchase of credits with other payment means, such as a credit card.

The invention is not limited to the above described embodiments and the skilled person will appreciate that many modifications and variants can be envisaged within the scope of the invention, which is defined solely by the following claims.

The invention claimed is:

1. An amusement machine of the pusher type, comprising:

a playing surface on which a plurality of playing pieces and one or more prizes are supported, wherein the one or more prizes have a shape and/or size differing from the shape and/or size of a playing piece of the plurality of playing pieces, and a playing piece pusher configured to move over the playing surface at successive points in time in order to disturb the plurality of playing pieces and one or more prizes supported on the playing surface, wherein the playing surface and the playing piece pusher are arranged such that one or more playing pieces and/or prizes can drop over an edge of the playing surface during movement of the playing piece pusher;

a transport system, comprising at least one collecting location for collecting the one or more playing pieces and prizes which have dropped over the edge, and at least one infeed location which lies higher than the at least one collecting location, wherein the transport system is configured to reintroduce the one or more playing pieces and prizes onto the playing surface from the at least one infeed location; and wherein the transport system is configured to transport the one or more playing pieces and prizes from the at least one collecting location to the at least one infeed location.

2. The amusement machine as claimed in claim 1, wherein the volume of a prize is at least twice the volume of a playing piece.

3. The amusement machine as claimed in claim 1, wherein the number of playing pieces is at least 10 times greater than the number of prizes.

4. The amusement machine as claimed in claim 1, wherein the transport system is configured to circulate the plurality of playing pieces and one or more prizes in at least one closed loop in the amusement machine.

5. The amusement machine as claimed in claim 1, wherein the at least one collecting location comprises a first collecting location configured to collect prizes without playing pieces and a second collecting location configured to collect playing pieces without prizes, and wherein the at least one infeed location comprises a first infeed location configured for infeed of prizes and a second infeed location configured for infeed of playing pieces.

6. The amusement machine as claimed in claim 5, wherein a first lift module configured to transport the prizes collected in the first collecting location is provided between the first collecting location and the first infeed location, and wherein a second lift module configured to transport the playing pieces collected in the second collecting location is provided between the second collecting location and the second infeed location.

7. The amusement machine as claimed in claim 6, wherein the first lift module comprises drive means for moving the lift module vertically upward from the first collecting location to the first infeed location and back, and a control unit for controlling the drive means in accordance with a state of the game.

8. The amusement machine as claimed in claim 6, wherein the second lift module comprises a hopper module configured to move the playing pieces upward in an orderly row.

9. The amusement machine as claimed in claim 6, further comprising a swing arm configured to: receive playing pieces from the second collecting location via the second lift module; and move over the playing surface, which swing arm is further configured to guide the playing pieces through the swing arm to an outlet of the swing arm, which outlet is located above the playing surface.

10. The amusement machine as claimed in claim 6, wherein the first lift module is provided with a receiving means which can be placed in a first position for receiving playing pieces and prizes in the first collecting location, and can be placed in a second position for dispensing playing pieces and prizes in the infeed location.

11. The amusement machine as claimed in claim 5, further comprising a sorting and discharge mechanism configured for sorting and discharging the one or more prizes and playing pieces which have dropped over the edge to the first collecting location and the second collecting location, respectively.

12. The amusement machine as claimed in claim 1, further comprising a detection module configured to detect one or more prizes which have dropped over the edge, and an award module for awarding a number of prize points to the player in accordance with the detected one or more prizes which have dropped over the edge.

13. The amusement machine as claimed in claim 1, wherein the transport system comprises an Archimedes screw with a lower end receiving prizes and/or playing pieces from a collecting location of the at least one collecting location and an upper end connected to an infeed location of the at least one infeed location.

14. The amusement machine as claimed in claim 1, wherein a guide in the form of inclining surface is provided between a first infeed location of the at least one infeed location and the playing surface, which guide is configured to guide the one or more playing pieces and/or prizes from the first infeed location to the playing surface.

15. An amusement machine of the multiplayer pusher type, comprising:

a plurality of playing surfaces, wherein a plurality of playing pieces and one or more prizes are supported on each playing surface, wherein the one or more prizes have a shape and/or size differing from the shape and/or size of a playing piece of the plurality of playing pieces, and for each playing surface, a playing piece pusher configured to move over the playing surface at successive points in time in order to disturb the plurality of playing pieces and one or more prizes supported on the playing surface, wherein the playing surface and the playing piece pusher are arranged such that one or more playing pieces and/or prizes can drop over an edge of the playing surface during movement of the playing piece pusher; and a transport system with at least one collecting location and at least one infeed location located thereabove, which transport system is configured to collect the one or more playing pieces and prizes which have dropped over the edge in the at least one collecting location, to transport the one or more playing pieces and prizes from the at least one collecting location to the at least one infeed location and to reintroduce the one or more playing pieces and prizes onto the playing surface from the at least one infeed location, wherein the plurality of playing surfaces are located substantially around a central zone, wherein at least a first collecting location of the at least one collecting location and a first infeed location of the at least one infeed location lie one above the other in the central zone.

16. An amusement machine of the pusher type, comprising: a playing surface on which a plurality of playing pieces and one or more prizes are supported, and a playing piece pusher configured to move over the playing surface at successive points in time in order to disturb the plurality of playing pieces and one or more prizes supported on the playing surface, wherein the playing surface and the playing piece pusher are arranged such that one or more playing pieces and/or prizes can drop over an edge of the playing surface during movement of the playing piece pusher; and a transport system comprising: a first collecting location configured to collect prizes and a second collecting location configured to collect playing pieces, said second location being different from said first location, a first infeed location configured for infeed of prizes and a second infeed location configured for infeed of playing pieces, a first lift module configured to transport the prizes collected in the first collecting location to the first infeed location, and a second lift module configured to transport the playing pieces collected in the second collecting location to the second infeed location.

17. The amusement machine of claim 16, wherein the one or more prizes have a shape and/or size differing from the shape and/or size of a playing piece of the plurality of playing pieces.

18. An amusement machine of the pusher type, comprising: a playing surface on which a plurality of playing pieces and one or more prizes are supported, wherein the one or more prizes have a shape and/or size differing from the shape and/or size of a playing piece of the plurality of playing pieces, and a playing piece pusher configured to move over the playing surface at successive points in time in order to disturb the plurality of playing pieces and one or more prizes supported on the playing surface, wherein the playing surface and the playing piece pusher are arranged such that one or more playing pieces and/or prizes can drop over an edge of the playing surface during movement of the playing piece pusher; wherein the one or more prizes comprise a transparent casing in which a valuable object and an identification means are arranged.

19. The amusement machine of claim 18, wherein the valuable object comprises cash money.

20. The amusement machine of claim 18, wherein the identification means comprises an RFID tag.

* * * * *